US006561847B1

(12) United States Patent
Xiang et al.

(10) Patent No.: US 6,561,847 B1
(45) Date of Patent: May 13, 2003

(54) INTEGRATED MULTIMEDIA INPUT/ OUTPUT PORT CONNECTOR ASSEMBLY

(75) Inventors: Xinghai Xiang, Kunsan (CN); Mingbo Shao, Kunsan (CN); Shiyou Wqng, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/036,977

(22) Filed: Dec. 29, 2001

(30) Foreign Application Priority Data

Dec. 19, 2001 (TW) ..... 090222273

(51) Int. Cl.[7] ..... H01R 13/60
(52) U.S. Cl. ..... 439/541.5; 439/540.1
(58) Field of Search ..... 439/541.5, 540.1, 439/607, 701, 79, 752

(56) References Cited

U.S. PATENT DOCUMENTS 6,056,594 A * 5/2000 Ching ..... 439/541.5
6,159,039 A * 12/2000 Wu ..... 439/541.5
6,368,150 B1 * 4/2002 Zheng et al. ..... 439/541.5

* cited by examiner

*Primary Examiner*—P. Austin Bradley
*Assistant Examiner*—Alexander Gilman
(74) *Attorney, Agent, or Firm*—Wei Te Chung

(57) ABSTRACT

An integrated multimedia input/output port connector assembly includes a bracket having a platform supported by opposite side panels to define a substantially closed upper chamber and a lower chamber. The upper chamber forms a rear opening between the side panels and a rear lid is removably attached to the side panels by means of sliding rail-groove engagement to close the opening. Three audio jacks are retained in the upper chamber with plug receiving bores of the jack exposed through cutoffs defined in the front panel. A DVI connector is received in the lower chamber. The DVI connector has a housing forming grooves on opposite side surfaces thereof for slidingly engaging with rails formed inside the lower chamber for guiding the DVI connector into the lower chamber. Steps are formed on the housing of the DVI connector for engaging retaining ribs formed inside the lower chamber for securing the DVI connector in the lower chamber. An inner wall is formed inside the lower chamber and closely next to a lower portion of the rear lid to define channels therebetween for receiving and retaining leads of the audio jacks.

11 Claims, 9 Drawing Sheets

INTEGRATED MULTIMEDIA INPUT/ OUTPUT PORT CONNECTOR ASSEMBLY

BACKGROUND OF THE INVENTION

1. Field of the Invention

The present invention generally relates to the field of electrical connectors and more particular to a connector assembly comprising audio and video output port connectors integrated together as a single unit.

2. The Related Arts

Electrical connectors are widely used to connect electrical apparatus. Computers are an example of the electrical apparatus that take advantage of electrical connector in connection with peripheral devices. The current trend of multimedia in the computer industry requires audio and video output ports to be provided in personal computers.

One of the commonly used audio output port in computers is the so-called "Audio Jacks". Usually, a set of three audio jacks is commonly mounted on the mother board of the computer, functioning to receive/transmit audio signals. On the other hand, the video output port is usually used to connect a computer monitor to a computer. One of the currently used video output ports is the so call "DVI (Digital Visual Interface) connector" which allows connection between a computer and a visual monitor, such as an LCD (Light Emitting Diode) panel. Conventionally, the DVI connector and the audio jacks are separately mounted to the computer mother board. This, of course, complicates the manufacturing of the computer mother board and increase costs of labor.

Further, mounting video and audio output ports separately on the computer mother board require a large amount of space on the mother board. This is adverse to the trend of miniaturization of the computer industry.

It is thus desirable to combine the audio and video output ports together as a single unit to overcome the above discussed disadvantages.

SUMMARY OF THE INVENTION

Accordingly, an object of the present invention is to provide an integrated multimedia input/output port connector assembly comprising a video output port stacked below a set of audio output ports as a single unit to simplify the manufacture of circuit boards with the input/output ports mounted thereon.

Another object of the present invention is to provide an integrated multimedia input/output port connector assembly comprising a video output port stacked below audio output ports for reducing footprint of the output ports on a circuit board.

A further object of the present invention is to provide a stacked connector comprising different multimedia output ports stacked over each other as a single unit for reducing labor and costs in mounting the output ports to circuit boards.

Yet a further object of the present invention is to provide an integrated multimedia output port assembly for computers.

To achieve the above objects, an integrated multimedia input/output port connector assembly in accordance with the present invention comprises a bracket having a platform supported by opposite side panels to define a substantially closed upper chamber and a lower chamber. The upper chamber forms a rear opening between the side panels and a rear lid is removably attached to the side panels by means of sliding rail-groove engagement to close the opening. Three audio jacks are retained in the upper chamber with plug receiving bores of the jack exposed through cutoffs defined in the front panel. A DVI connector is received in the lower chamber. The DVI connector has a housing forming grooves on opposite side surfaces thereof for slidingly engaging with rails formed inside the lower chamber for guiding the DVI connector into the lower chamber. Steps are formed on the housing of the DVI connector for engaging retention ribs formed inside the lower chamber for securing the DVI connector in the lower chamber. An inner wall is formed inside the lower chamber and closely next to a lower portion of the rear lid to define channels therebetween for receiving and retaining leads of the audio jacks.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
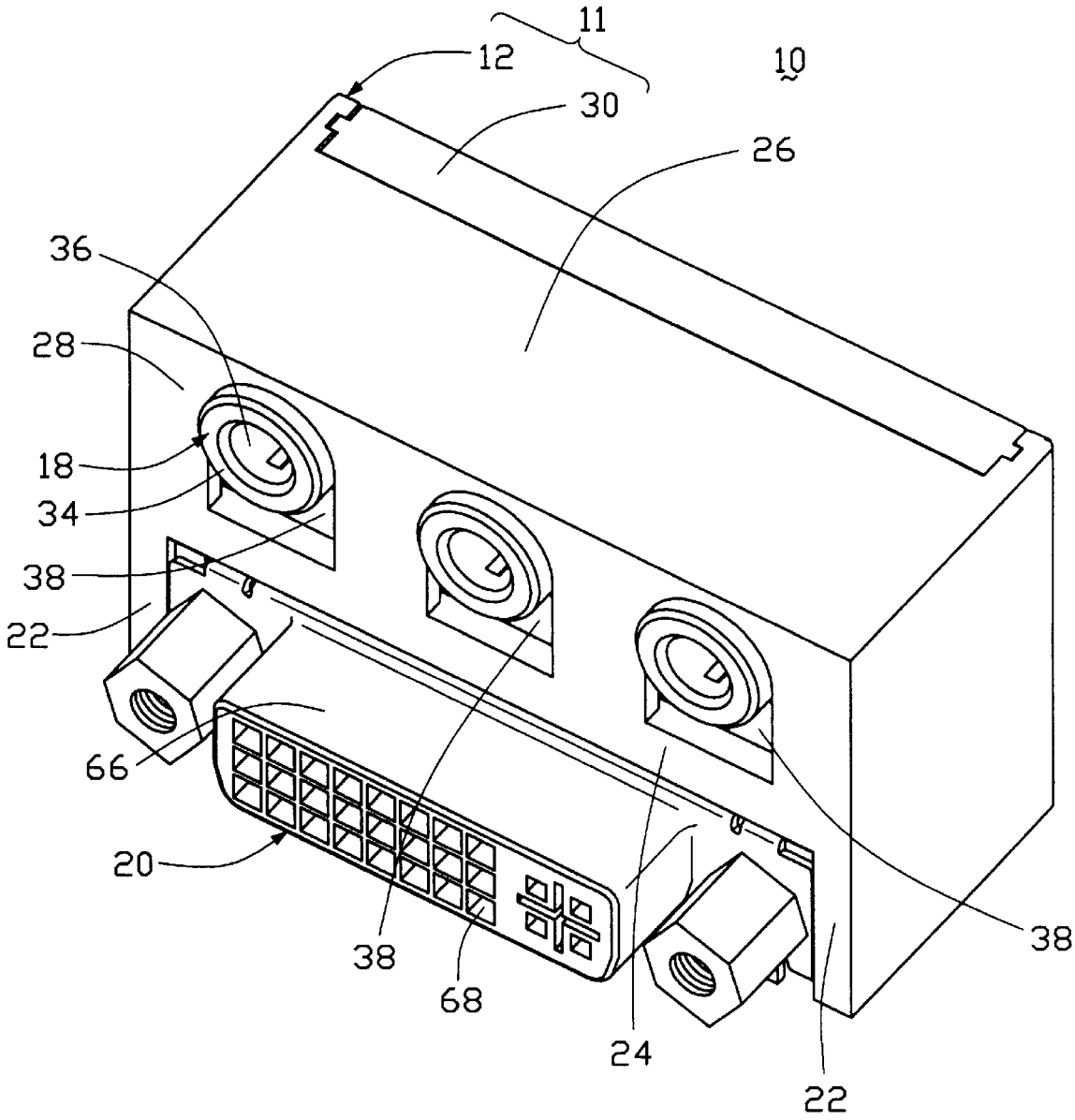
FIG. 1 is a perspective view of an integrated multimedia input/output port connector assembly constructed in accordance with the present invention.
Figure 2:
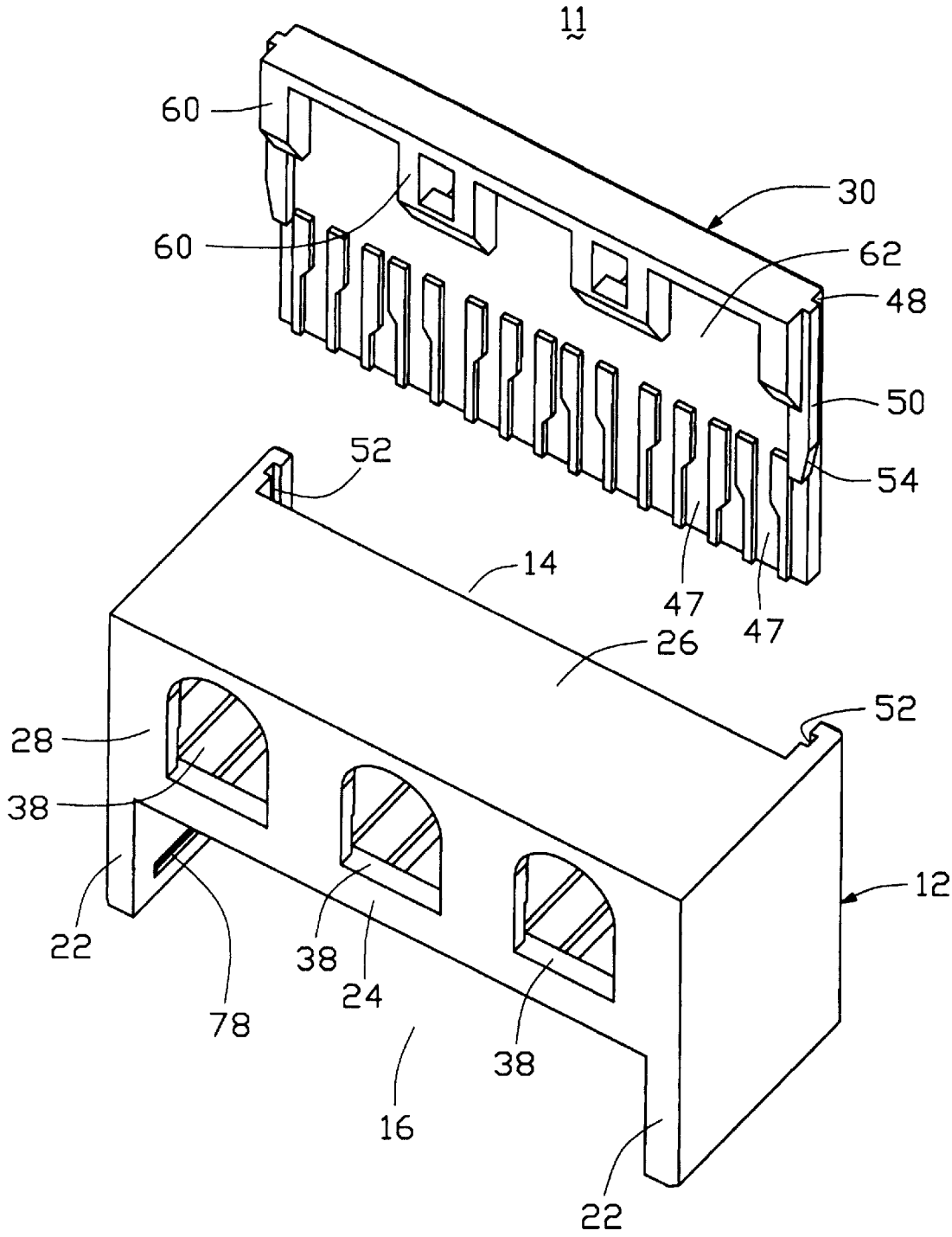
FIG. 2 is an exploded view of an outer housing of the connector assembly of the present invention.

With reference to the drawings and in particular to FIGS. 1 and 2, an integrated multimedia input/output port connector assembly constructed in accordance with the present invention, generally designated with reference numeral 10, has an outer housing 11 comprising a bracket 12 and a rear lid 30. The bracket 12 forms an upper chamber 14 and a lower chamber 16 in a vertical direction for respectively receiving a set of audio port units 18 (also see FIG. 11) for connection with external audio devices, such as a microphone and a speaker, and a video port unit 20 (also see FIG. 6) for connection with external video device, such as a digital flat panel monitor, for example an Liquid Crystal Display (LCD) monitor. In the embodiment illustrated, the audio port units 18 are three audio jacks and the video port unit 20 is a Digital Visual Interface (DVI) connector. It is, however, understood that the audio port units 18 and the video port unit 20 can be other devices having similar function of connection audio and video devices.

Figure 5:
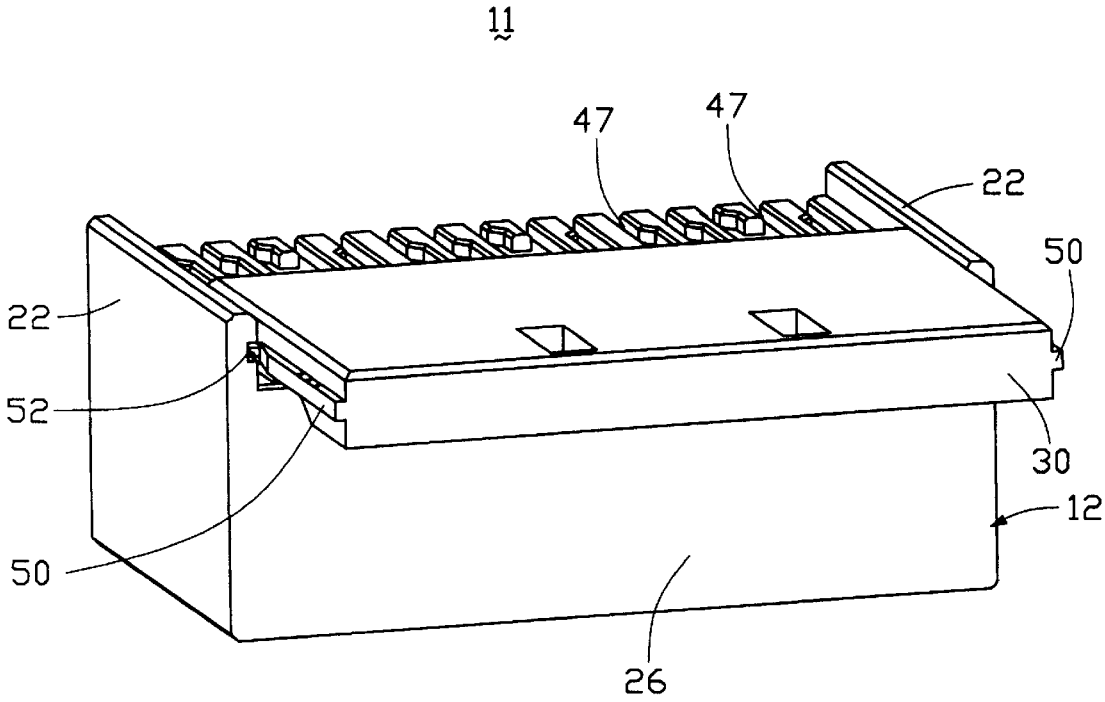
FIG. 5 is a partially assembled view of the outer housing in a different perspective from FIG. 2.
Figure 7:
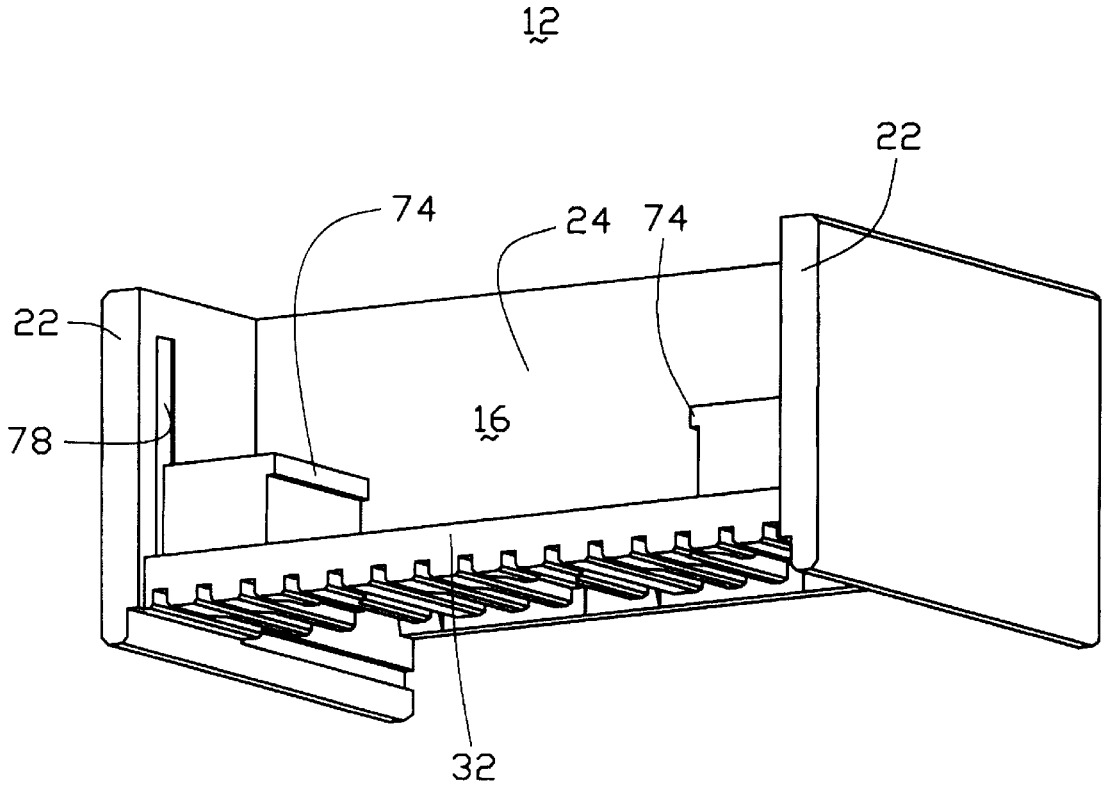
FIG. 7 is another perspective view of a bracket of the outer housing with the lid removed.

Also referring to FIGS. 5 and 7, the bracket 12 comprises a base frame (not labeled) comprising two spaced and substantially parallel side panels 22 and a platform 24 extending between the side panels 22 thereby forming an H-shaped frame. The side panels 22 are substantially rectangular, having top, bottom, front and rear edges (all not labeled for simplicity of the drawings). A top panel 26 extends between the top edges (not labeled) of the side panels 22 and an upper front panel 28 extends between the front edges of the side panels 22 and between the top panel 26 and the platform 24. The rear lid 30 is removably mounted between the rear edges of the side panels 22 thereby defining, together with the top panel 26, the platform 24, the upper front panel 28 and the side panels 22, a substantially closed interior space above the platform 24, serving as the upper chamber 14 for accommodating the audio jacks 18 as mentioned previously.

An inner wall 32 is formed inside the lower chamber 16 and extending between the side panels 22 to define, together with the platform 24 and the side panels 22, an interior space of the lower chamber 16 for accommodating the DVI connector 20. The rear lid 30 is preferably sized to have a lower portion thereof substantially overlapping the inner wall 32. This will be further discussed.

Figure 11:
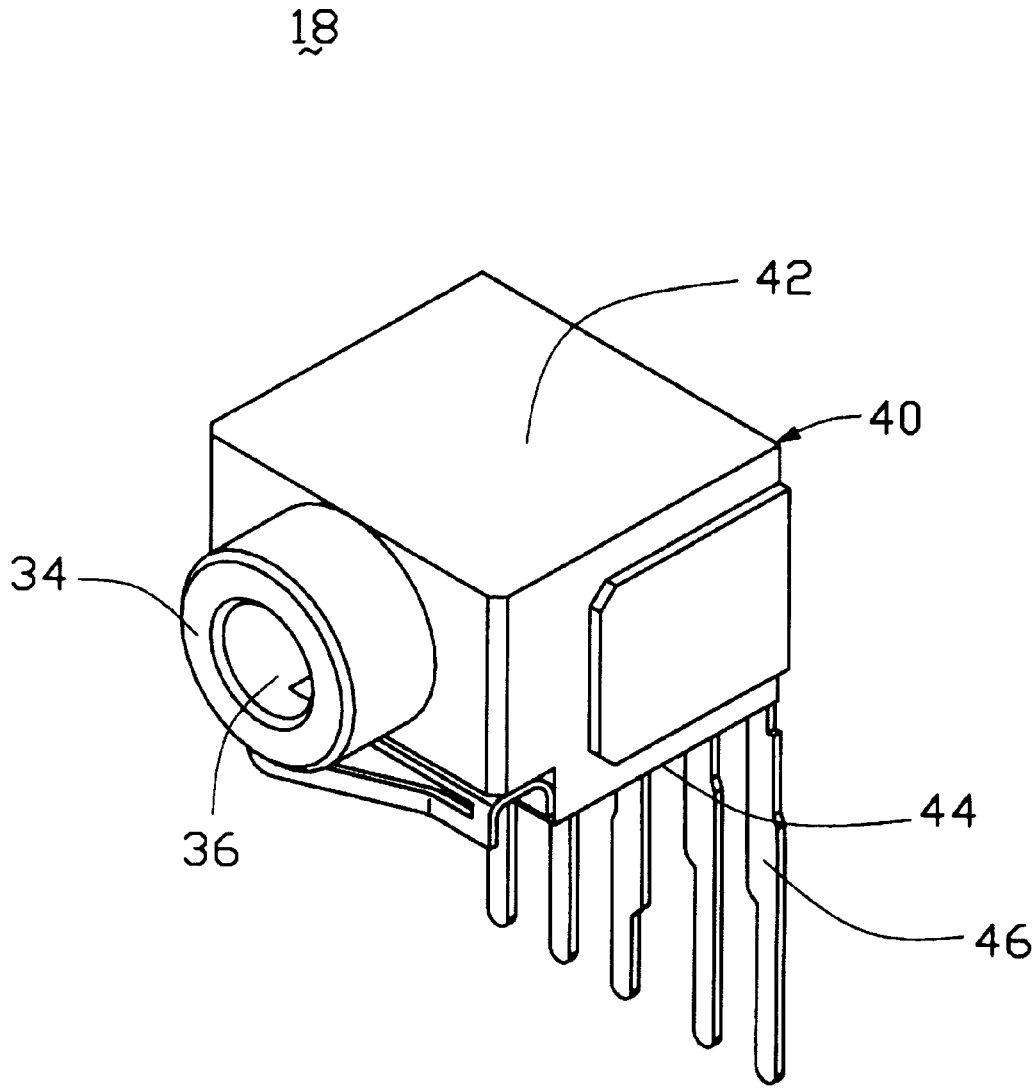
FIG. 11 is a perspective view of an audio port connector in accordance with the present invention.

Also referring to FIG. 11, it is commonly known to those having ordinary skills in the art the each audio jack 18 has a cylindrical projection 34 defining a central bore 36 for receiving an audio plug of the external audio device (not shown). To expose the central bore 36 of each audio jack 18, an opening 38 is defined in the upper front panel 28 for partial extension of the cylindrical projection 34 of each audio jack 18. Each audio jack 18 is provided with a housing 40 having substantially parallel upper and lower faces 42, 44 spaced from each other a predetermined distance. The distance between the upper and lower faces 42, 44 of is substantially equal to a distance between the top panel 26 and the platform 24 so as to have the audio jacks 18 snugly received between the top panel 26 and the platform 24 with the cylindrical projection 34 partially extending beyond the upper front panel 28 through the associated opening 38. Each audio jack 18 comprises a number of conductive leads 46 extending along the inner wall 32 toward and beyond a lower edge of the inner wall 32. In this respect, the inner wall 32 is arranged closely next to the lower portion of the rear lid 30. Aligned pairs of grooves 47 (FIGS. 2, 7 and 8) are defined in an inside surface 62 of the rear lid 30 and an opposing face (not labeled) of the inner wall 32 to form channels for the extension of the audio jack leads 46. The inner wall 32 serves as a spacer of the audio jack leads 46.

Figure 3:
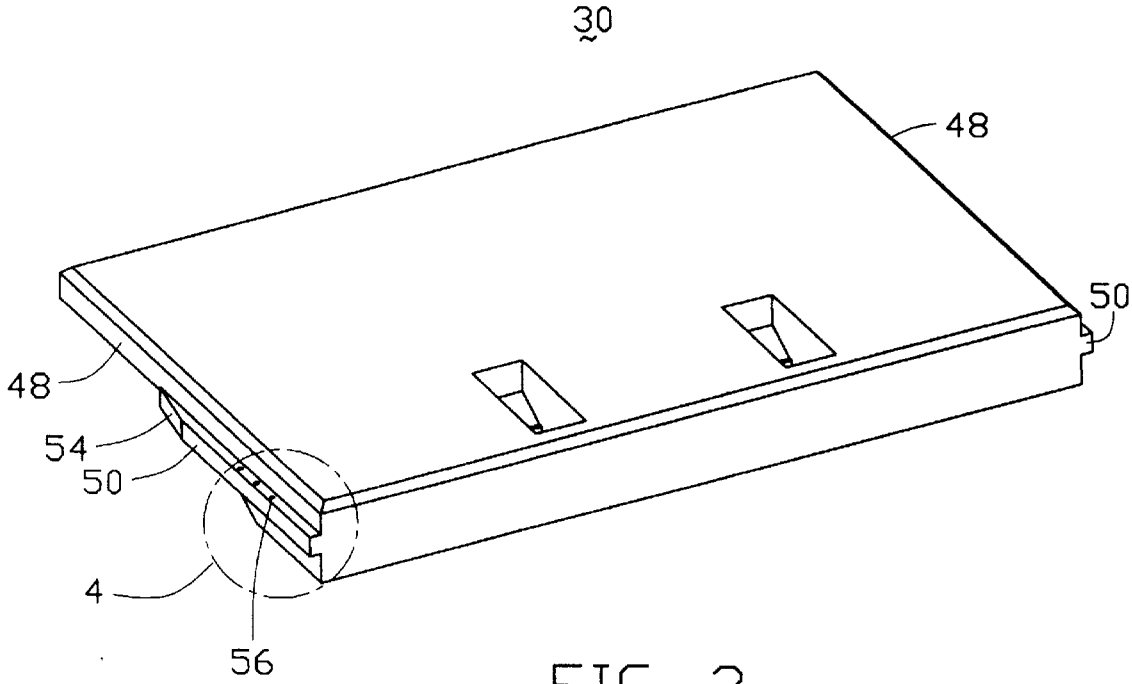
FIG. 3 is a perspective view of a rear lid of the outer housing of the present invention.

Also referring to FIG. 3, the rear lid 30 has opposite lateral edges 48 corresponding to inner surfaces (not labeled) of the side panels 22. A rib 50 is formed along, at least partly, each lateral edge 48 of the rear lid 30. A corresponding slot 52 is defined in the inner surface of the corresponding side panel 22 and extending along and adjacent to the rear edge of the side panel 22 for slidingly and guidingly receiving the ribs 50 to mount the rear lid 30 to the rear edge of the side panel 22. To facilitate inserting the rib 50 into the slot 52, the rib 50 is provided with a chamber forming an inclined face 54 for guiding the rib 50 into the slot 52.

Figure 4:
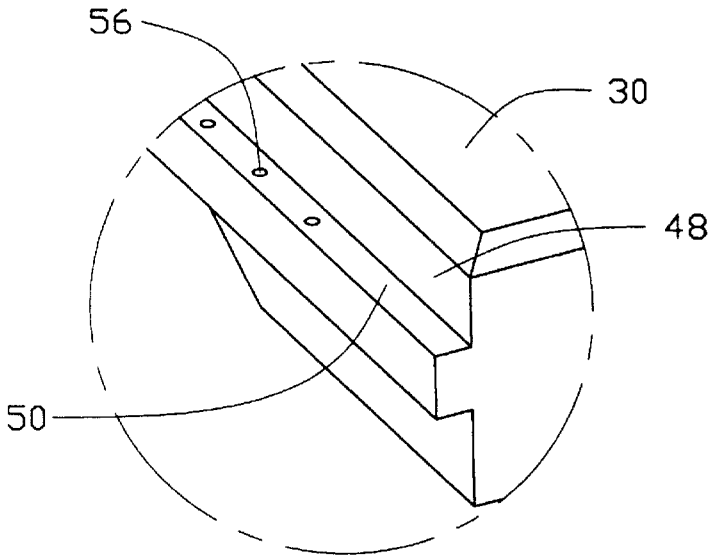
FIG. 4 is an expanded view of encircle portion 4 of FIG. 3.

Also referring to FIG. 4, small bead-like projections 56 are formed on a side surface 58 of each rib 50 for interferentially engaging a corresponding side wall (not labeled) of the slot 52 to retain the rear lid 30 in position.

A number of raised portions 60 (FIG. 2) are formed on the inside surface 62 of the rear lid 30 for contacting and retaining the audio jacks 18 inside the upper chamber 14.

Figure 6:
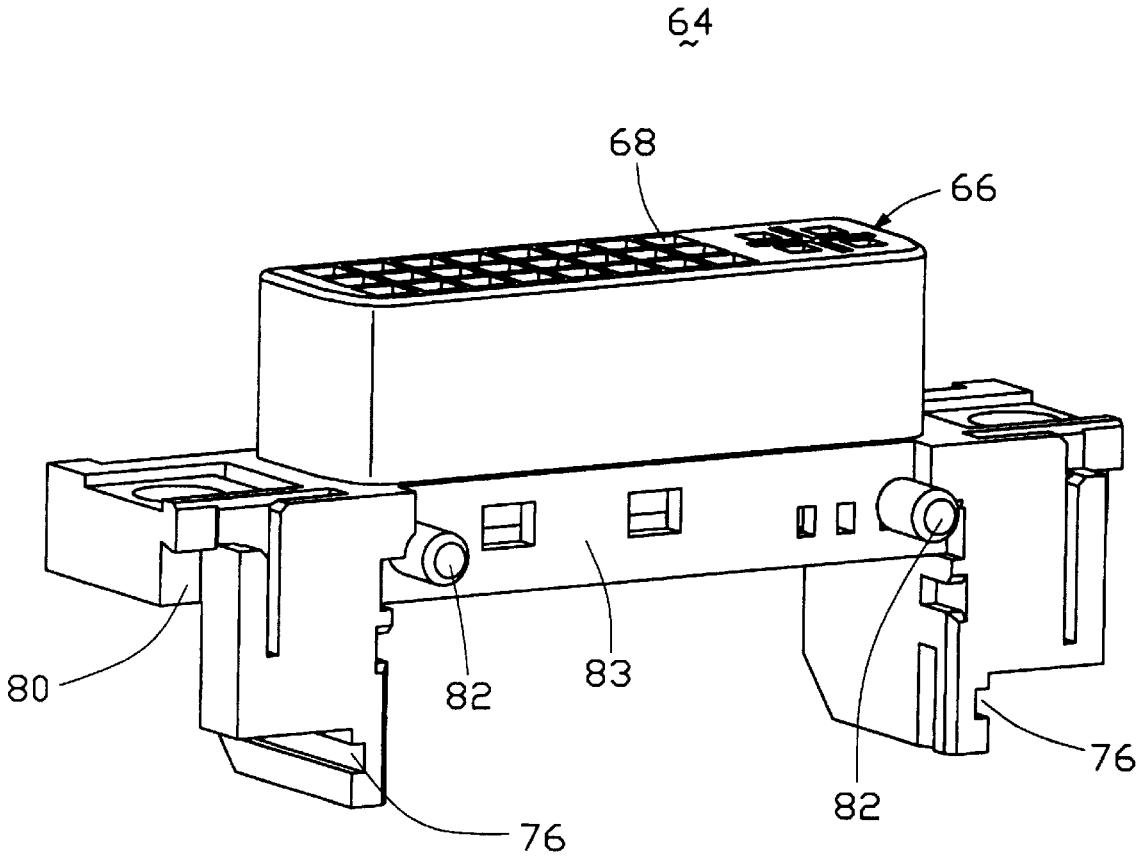
FIG. 6 is a perspective view of a housing of a video port connector of the connector assembly in accordance with the present invention.
Figure 8:
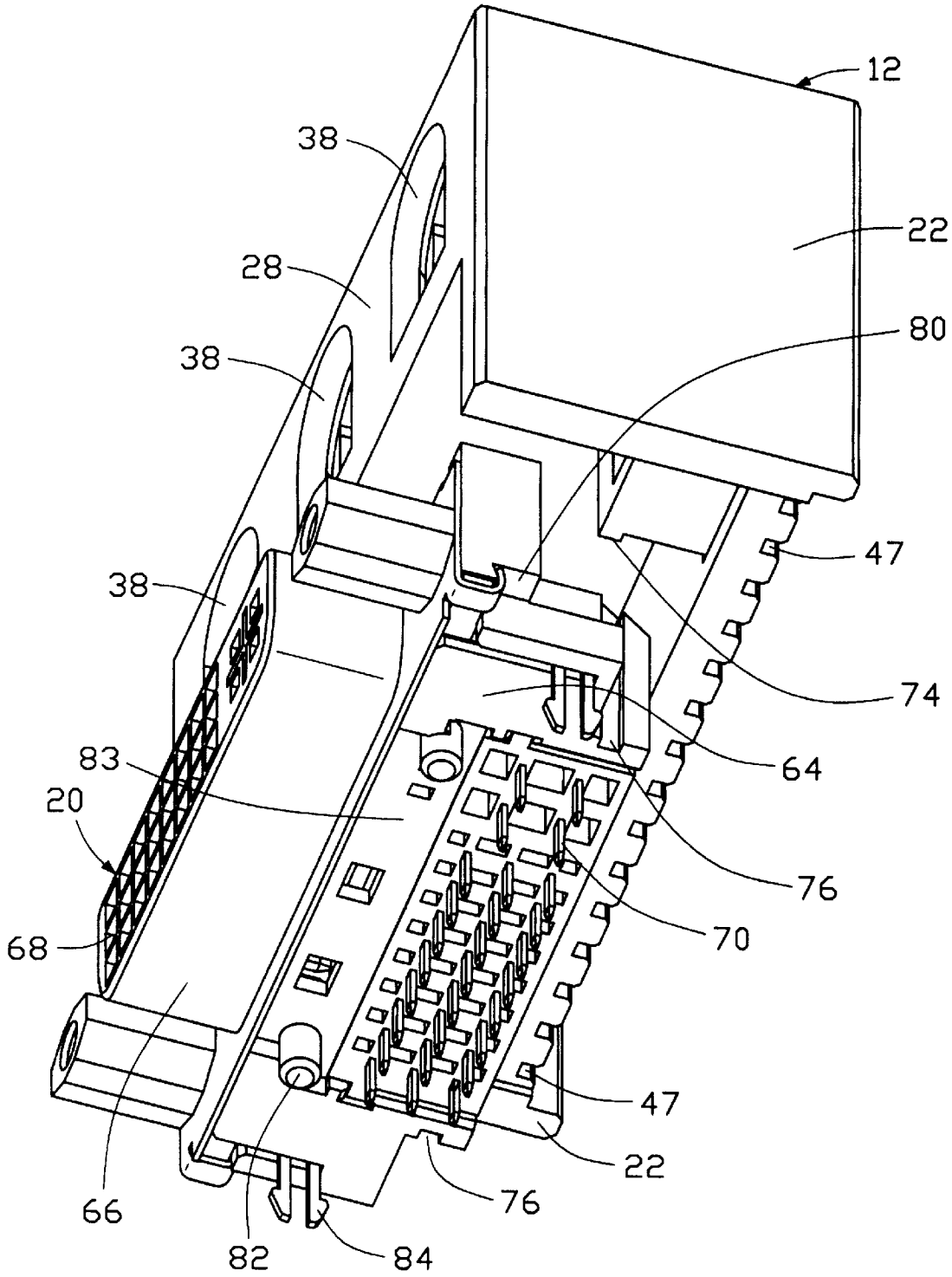
FIG. 8 is a partially assembled view of the connector assembly of the present invention in a different perspective.
Figure 9:
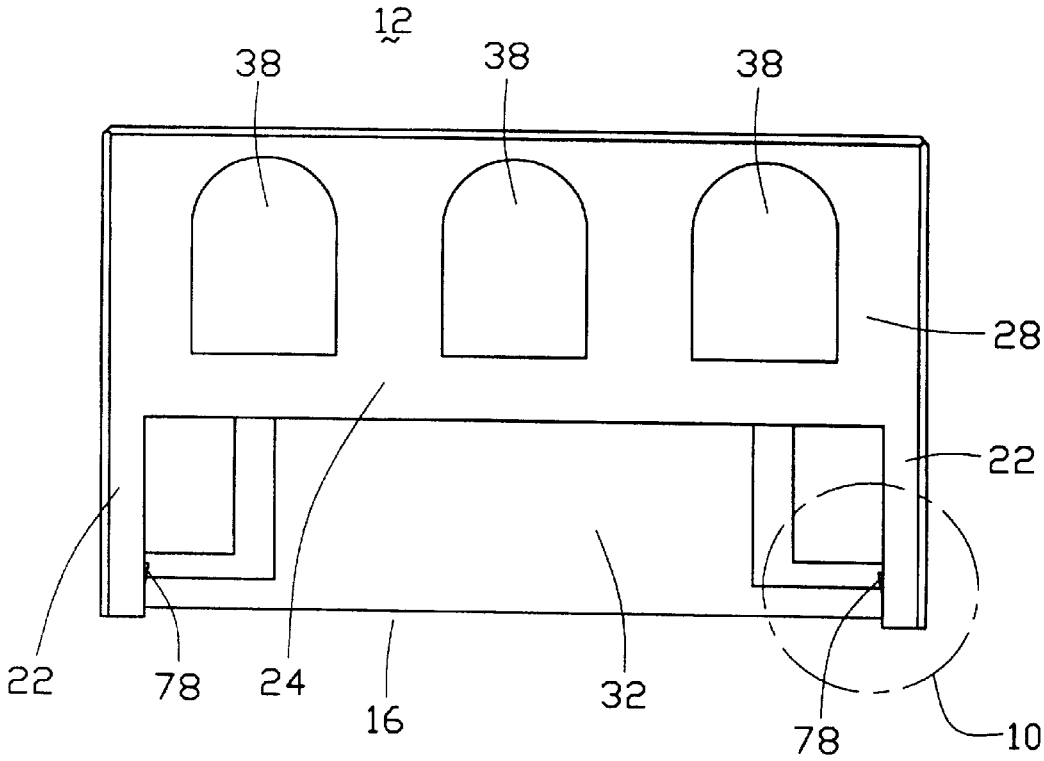
FIG. 9 is a front view of the bracket of the outer housing.
Figure 10:
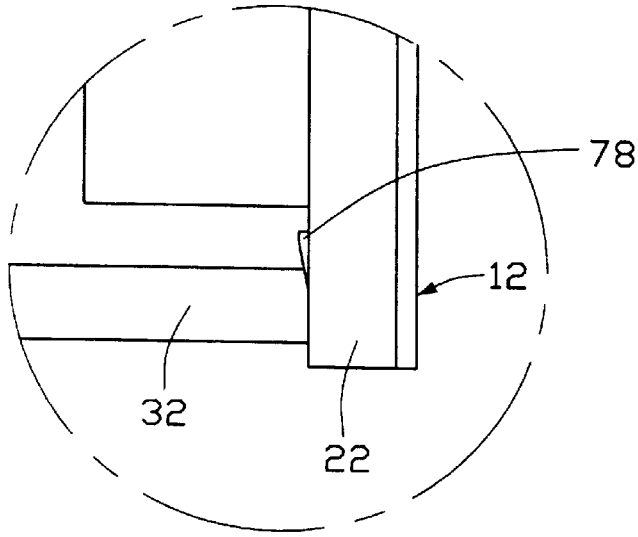
FIG. 10 is an expanded view of encircled portion 5 of FIG. 9.

Also referring to FIGS. 6 and 8, the DVI connector 20 comprises a housing 64 substantially received in the lower chamber 16. The housing 64 forms a front projection 66 defining passageways 68 therein for receiving and retaining conductive contacts 70 (only shown in FIG. 8 for simplicity). The conductive contacts 70 extend beyond the lower edges of the side panels 22 for being soldered to a printed circuit board (not shown). Two guiding flanges 74 (also see FIG. 7) are formed inside the lower chamber 16, extending in the vertical direction, for slidingly engaging grooves 76 defined in the housing 64 of the DVI connector 20 and guiding the DVI connector 20 into the lower chamber 16 of the bracket 12 from the bottom side of the bracket 12. Retaining ribs 78 (FIGS. 7, 9 and 10) are formed on inside surfaces (not labeled) of the side panels 22 for engaging with steps 80 formed on the housing 64 to secure the DVI connector 20 inside the lower chamber 16.

Positioning pins 82 extend from a lower face 83 of the housing 64 of the DVI connector 20 for engaging with corresponding holes defined in the circuit board thereby properly positioning the integrated multimedia input/output port connector assembly 10 on the circuit board. Board locks 84 extend beyond the lower face of the hosing 64 for attaching the integrated multimedia input/output port connector assembly 10 to the circuit board.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An electrical connector assembly comprising:

a bracket comprising a platform and forming upper and lower chambers respectively above and below the platform in a vertical direction;

an audio port unit received and retained in the upper chamber and defining a bore exposed through a front side of the bracket for releasably and receivingly engaging a corresponding connection member of an external audio device; and a video port unit inserted into the lower chamber from a bottom of the lower chamber and comprising a mating portion exposed through a front side of the bracket for engaging a corresponding connection member of an external video device wherein the upper chamber is substantially closed by surrounding casing comprising at least a front portion in which an opening is defined for exposing the bore of the audio port unit, wherein guiding rails are formed inside the lower chamber and extending in the vertical direction, the video port unit comprising a housing forming grooves corresponding to and receivingly engaging the rails for guiding the video port unit into the lower chamber, wherein retaining ribs are formed inside the lower chamber for engaging steps formed on the housing of the video port unit to secure the video port unit inside the lower chamber.

2. The electrical connector assembly as claimed in claim 1, wherein grooves are defined in an inner wall of the lower chamber for receiving and retaining leads of the audio port unit.

3. The electrical connector assembly as claimed in claim 1, wherein the casing that surrounds the upper chamber comprises a detached lid shielding an opening defined in a rear portion of the casing, the lid comprising guiding ribs formed on opposite lateral edges thereof slidingly received in corresponding grooves defined in opposite side portions of the casing for attaching the lid to the casing.

4. The electrical connector assembly as claimed in claim 3, wherein an inclined face is formed on each guiding rib for facilitating the engagement of the rib with the corresponding groove.

5. The electrical connector assembly as claimed in claim 3, wherein bead-like projections are formed on a side face of the rib for interferentially engaging a side wall of the groove.

6. The electrical connector assembly as claimed in claim 1, wherein the casing that surrounds the upper chamber comprises a detached lid shielding an opening defined in a rear portion of the casing, the lid having an extension overlapping an inner wall formed inside in the lower chamber with channels defined therebetween for receiving and retained leads of the audio port unit.

7. The electrical connector assembly as claimed in claim 1, wherein the audio port unit comprises an audio jack.

8. The electrical connector assembly as claimed in claim 7, wherein the electrical connector assembly comprises three audio jacks retained in the upper chamber.

9. An integrated multimedia input/output port electrical connector assembly comprising:

a bracket comprising a platform supported by opposite side panels, the side panels having top, bottom, front and rear edges, a top panel extending between the top edges of the side panel, a front panel extending between the front edges of the side panels and between the platform and the top panel, a rear lid removably attached to the rear edges of the side panels to define a substantially closed upper chamber above the platform, a lower chamber being defined between the side panels and below the platform whereby the upper chamber is located above the lower chamber in a vertical direction;

an audio port unit received in the upper chamber and retained in position by the top panel and the platform, each audio port comprising a front portion defining a bore exposed through a front panel of the bracket for releasably and receivingly engaging a corresponding plug of an external audio device; and a video port unit inserted into the lower chamber from a bottom of the lower chamber and comprising a mating portion exposed through a front side of the bracket for engaging a corresponding connection member of an external video device wherein the connector assembly comprises three audio jacks retained in the upper chamber in side by side fashion, wherein the video port comprises a DVI connector, wherein a housing of said DVI connector forming grooves on opposite side surfaces thereof for slidingly engaging guiding rails formed inside the lower chamber and extending in the vertical direction for guiding the DVI connector into the lower chamber, wherein the housing of said DVI connector forms steps for engaging rib formed inside the lower chamber.

10. The integrated multimedia input/output port electrical connector assembly as claimed in claim 9, wherein the rear lid has opposite lateral edges each forming a rib and wherein a groove is defined in an inside face of each side panel and extending along and next to the rear edge thereof for guidingly and slidingly receiving the rib of the lid therein for attaching the lid to the side panels.

11. The integrated multimedia input/output port electrical connector assembly as claimed in claim 10, wherein each rib forms an inclined face for facilitation engagement of the rib with the corresponding groove.

* * * * *